US006701590B2

(12) United States Patent
Voughlohn

(10) Patent No.: US 6,701,590 B2
(45) Date of Patent: Mar. 9, 2004

(54) UNIQUE SYSTEMS AND METHODS FOR LOCKING FOOTWEAR

(76) Inventor: Dee Voughlohn, 4171 NE. 125th Pl., Portland, OR (US) 97230

( * ) Notice: Subject to any disclaimer, the term of this patent is extended or adjusted under 35 U.S.C. 154(b) by 0 days.

(21) Appl. No.: 09/927,877

(22) Filed: Aug. 10, 2001

(65) Prior Publication Data

US 2002/0020046 A1 Feb. 21, 2002

Related U.S. Application Data

(60) Provisional application No. 60/224,580, filed on Aug. 11, 2000.

(51) Int. Cl.[7] ..... A43C 7/00

(52) U.S. Cl. ..... 24/712.2; 24/712.3; 36/50.1

(58) Field of Search ..... 24/712.1, 712.2, 24/712.3, 129 R, 128, 265 R, 66.3; 36/50.1, 54, 114; D02/896

(56) References Cited

U.S. PATENT DOCUMENTS

| | | | | | |
|---|---|---|---|---|---|
| 1,530,314 | A | * | 3/1925 | Ford | 36/50.1 |
| 3,908,238 | A | | 9/1975 | Richard | 24/119 |
| 4,114,297 | A | | 9/1978 | Famolare, Jr. | 36/50 |
| 4,200,998 | A | | 5/1980 | Adams | 36/50 |
| 4,291,439 | A | | 9/1981 | Riti | 24/119 |
| 4,571,854 | A | | 2/1986 | Edens | 36/50 |
| 4,571,856 | A | | 2/1986 | Lin et al. | 36/89 |
| 4,715,094 | A | | 12/1987 | Herdman | 24/119 |
| 4,766,682 | A | | 8/1988 | Malloy, III | 36/132 |
| 4,879,787 | A | | 11/1989 | Walls | 24/712 |
| 4,949,437 | A | | 8/1990 | Anderson | 24/712 |
| 5,042,119 | A | | 8/1991 | Williams | 24/712 |
| 5,129,130 | A | * | 7/1992 | Lecouturier | 24/712 |
| 5,333,398 | A | * | 8/1994 | Seo | 24/712.9 |
| 5,347,695 | A | * | 9/1994 | Lopez Saiz | 24/714.8 |
| 5,459,947 | A | * | 10/1995 | Lasher | 36/54 |
| 5,572,778 | A | * | 11/1996 | Stenner et al. | 24/712.7 |
| 5,649,342 | A | * | 7/1997 | D'Andrade et al. | 24/712.2 |
| 5,671,517 | A | * | 9/1997 | Gourley | 24/712.1 |
| 5,778,500 | A | * | 7/1998 | Illingworth | 24/712.3 |
| 5,953,800 | A | * | 9/1999 | Duckett | 24/129 R |
| 6,000,111 | A | * | 12/1999 | Deskins et al. | 24/442 |
| 6,119,318 | A | * | 9/2000 | Maurer | 24/130 |
| 6,408,542 | B1 | * | 6/2002 | Shepherd | 36/54 |
| 6,473,999 | B2 | * | 11/2002 | Fellouhe | 36/50.1 |

FOREIGN PATENT DOCUMENTS

| | | | |
|---|---|---|---|
| JP | 04-64301 | * | 2/1992 |

* cited by examiner

*Primary Examiner*—Anthony Knight
*Assistant Examiner*—André L. Jackson

(57) ABSTRACT

A unique system comprises a tongue of a footwear, a lace, a lace-end fastener, and a lace-section fastener. The footwear has two opposite sides and lace-receivers disposed thereon. To assemble the unique system, the footwear is laced with the lace to define opposite lace sections, each of which extends between two of the lace receivers on the same side. The tongue has at least one opening. The lace is threaded through the at least one opening. Then, the lace ends are fastened by the lace-end fastener and are hidden inside the tongue and prevented from moving. The lace-section fastener is for the opposite lace sections to be fastened thereon and to be unfastened therefrom, to fasten the footwear onto and to unfasten the footwear from a foot, respectively.

8 Claims, 2 Drawing Sheets

UNIQUE SYSTEMS AND METHODS FOR LOCKING FOOTWEAR

REFERENCE TO PREVIOUSLY FILED PROVISIONAL PATENT APPLICATION

Provisional Patent Application No. 60/224,580 was filed on Aug. 11, 2000.

TECHNICAL FIELD OF THE INVENTION

The application applies for unique systems and methods for locking lacing-type footwear.

BACKGROUND OF THE INVENTION

Lacing-type footwear is an important part of our life, but adjusting, tying, and untying a lace are time-consuming and frustrating. Plus, a bow knot is snagging and cumbersome. Accordingly, there are ever-increasing demands for a convenient, safe, and aesthetic system, which could fasten a footwear quickly and easily, and is affordable, compact, and simple without exposing a bow knot.

PRIOR ART

Prior arts heretofore have snagging and poking problem of either a bow knot or a cumbersome, hazardous device. A number of cumbersome, hazardous devices have been introduced in:

the U.S. Pat. No. 4,291,439 filed Sep. 29, 1981; the U.S. Pat. No. 4,200,998 filed May. 06, 1980; the U.S. Pat. No. 5,042,119 filed Aug. 27, 1991; the U.S. Pat. No. 4,879,787 filed Nov. 14, 1989; the U.S. Pat. No. 4,114,297 filed Sep. 19, 1978; the U.S. Pat. No. 4,766,682 filed Aug. 30, 1988; the U.S. Pat. No. 4,571,856 filed Feb. 25, 1986; the U.S. Pat. No. 4,949,437 filed Aug. 21, 1990; the U.S. Pat. No. 4,715,094 filed Dec. 29, 1987; the U.S. Pat. No. 3,908,238 filed Sep. 30, 1975; and the U.S. Pat. No. 4,571,854 filed Apr. 22, 1983. These patents teach that to fasten a footwear onto a foot, a user ties lace ends of a lace together, fastens them to a cumbersome, hazardous, expensive device, and exposes them, causing snagging, poking, abrading problem and, therefore, inevitable personal injury. Therefore, all prior arts heretofore teach away from the invention.

OBJECTS AND ADVANTAGES OF THE INVENTION

Having many advantages over all the prior arts heretofore, the unique system of the invention:

- hides lace ends and lace-end fastener inside a footwear tongue and prevent them from moving;
- fastens the tongue of a footwear in place when fastening the footwear onto a foot;
- only needs to be assembled once to set predetermined lace tensions, which can be reset any time;
- eliminates the needs for adjusting, tying a lace every time a footwear is fastened onto a foot;
- eliminates the needs for adjusting, untying a lace every time a footwear is unfastened from a foot;
- is inexpensive, compact, safe, and simple. Thus, it can be used by people of almost any age;
- applies interlock method. Thus, the harder it is pulled, the more securely it fastens a footwear;
- only needs to be assembled once; only needs one finger to be operated; and can also serve as a safety system when, for example, partially or entirely made of light-reflecting material.

Other objects and advantages will become apparent from the ensuing specification and drawings.

SUMMARY OF THE INVENTION

A unique system comprises a tongue of a footwear, a lace, a lace-end fastener, and a lace-section fastener. The footwear has two opposite sides and lace-receivers disposed thereon. To assemble the unique system, the footwear is laced with the lace to define opposite lace sections, each of which extends between two of the lace receivers on the same side. The tongue has at least one opening. The lace is threaded through the at least one opening. Then, the lace ends are fastened by the lace-end fastener and are hidden inside the tongue and prevented from moving. The lace-section fastener is for the opposite lace sections to be fastened thereon and to be unfastened therefrom, to fasten the footwear onto and to unfasten the footwear from a foot, respectively.

FIRST EXAMPLE

Figure 1:
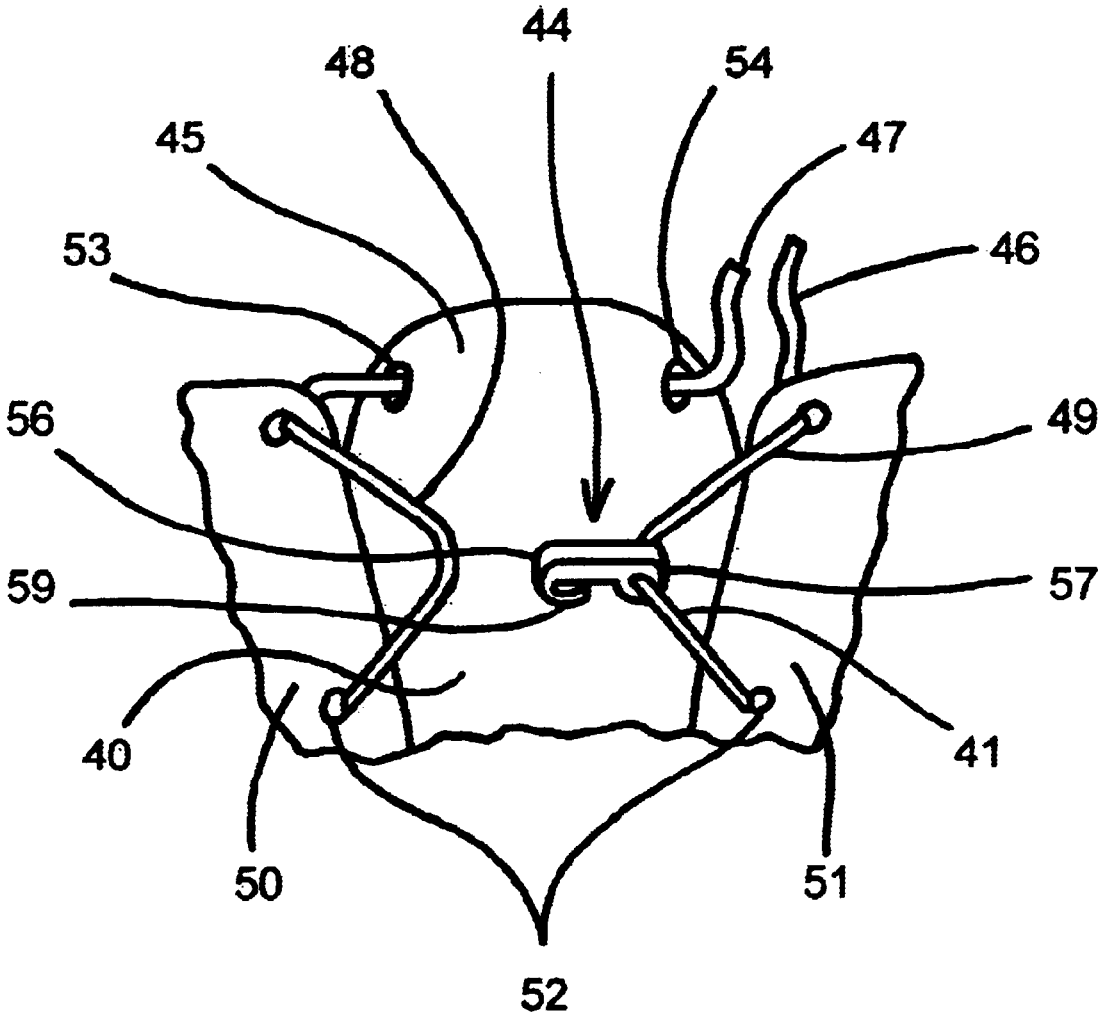
FIG. 1 shows top view of the unique system.

FIG. 1 shows a unique system for fastening a footwear onto a foot. The unique system comprises a tongue 40 of the footwear, a lace 41, a lace-section fastener 44, and a lace-end fastener. The footwear has opposite sides 50 and 51 and a plurality of lace-receivers 52 disposed thereon. Tongue 40 has a tongue top 45, outer and inner surfaces, and two openings 53 and 54. Each of openings 53 and 54 extends from the outer surface to the inner surface of tongue 40. Lace 41 has opposite lace sections 48 and 49 and lace ends 46 and 47. The lace-end fastener comprises lace ends 46 and 47. Lace-section fastener 44 comprises a hook 56 and a ring 57 attached to or integrated to each other. Ring 57 has a hole and is capable of securely fastening lace section 49 thereon when lace section 49 is threaded through the hole of ring 57. Hook 56 has a tip 59. Tip 59 is predeterminedly bent inward to narrow the mouth of hook 56 so that tip 59 is capable of preventing hook 56 from snagging, poking, etc. and so that hook 56 is capable of securely fastening lace section 48 thereon when lace section 48 is hooked thereon.

To assemble the unique system, the footwear is laced with lace 41 so that each of lace sections 48 and 49 extends between two of lace receivers 52 on the same side of opposite sides 50 and 51, with lace section 49 threaded through the hole of ring 57 to fasten lace section 49 onto lace-section fastener 44. Next, lace 41 is threaded through openings 53 and 54. Then, lace ends 46 and 47 are tied together so that they are fastened together, to set predetermined lace tensions of lace 41, and are hidden securely inside tongue top 45 so that lace ends 46 and 47 are secured in place and prevented from moving, and so that lace ends 46 and 47 stay above the rest of lace 41. To fasten the footwear onto a foot after inserting the foot thereinto, pull opposite lace sections 48 and 49 to increase the tension of lace 41, and hook lace section 48 on hook 56 to fasten lace section 48 onto lace-section fastener 44. To unfasten the footwear from the foot, unhook lace section 48 from hook 56 to unfasten lace section 48 from lace-section fastener 44. For example, to unhook lace section 48 from hook 56, lift hook 56 until lace section 48 slides off hook 56.

VARIATION, RAMIFICATION, AND CONCLUSION

Figure 2:
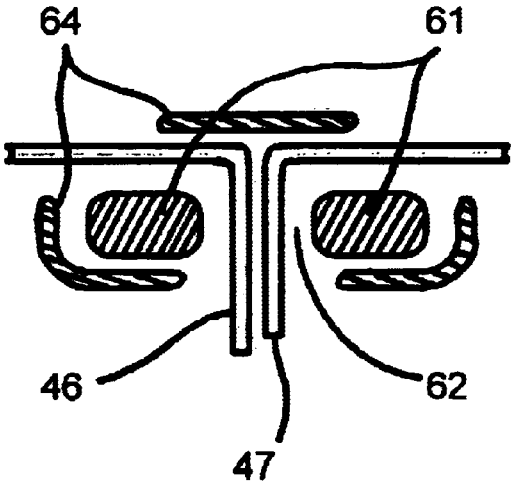
FIG. 2 shows a cross-section of a tongue.
Figure 3:
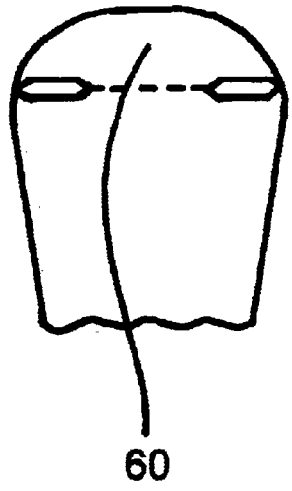
FIG. 3 shows a tongue.

A tongue, equivalent to tongue 40, can have at least one opening, each of which can have any shape and size, can be disposed at any location thereon in any direction. For example, FIG. 2 shows a cross section of a tongue 64, equivalent to tongue 40. Tongue 64 has three openings and a padding 61. Padding 61 has a padding opening 62. Each of lace ends 46 and 47 is threaded through one opening, through padding opening 62, and through the last opening. Lace ends 46 and 47 are tied together so that they are fastened together, to set predetermined lace tensions of lace 41, and are hidden securely inside the tongue top of tongue 64 and prevented from moving. For example, FIG. 3 shows a tongue, equivalent to tongue 40. The tongue has two openings and is sewed between its two openings to define its tongue top 60, which is for lace ends and lace-end fastener to be hidden therein and prevented from moving. To define its tongue top 60, thread or any other attaching device can be used, for example, glue, rivet, velcro, snap-lock, the like, etc. For example, a tongue, equivalent to tongue 40, has at least one opening . One or each of lace ends 46 and 47 can be threaded through at least one of the at least one opening of the tongue.

A tongue, equivalent to tongue 40, can have no padding or can have at least one padding inside. Each padding can have no opening nor recess, or can have at least one opening and/or recess, for lace ends and lace-end fastener to be threaded therethrough and/or to be hidden therein and prevented from moving. For example, FIG. 2 shows padding 61 having padding opening 62.

Figure 4:
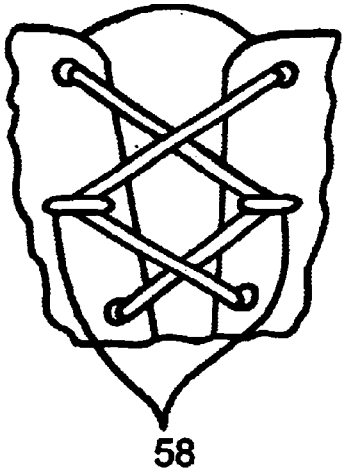
FIG. 4 shows a lace-section fastener.

The unique system can partially or entirely be made of material(s), which is elastic, non-elastic, transparent, flexible, resilient, rigid, semi-rigid, fluorescent, light-reflecting, glittered, glow-in-the-dark, fabric, cotton, leather, vinyl, nylon, rubber, plastic, thread, eye-catching, metallic, steel, bronze, zinc, copper, iron, alloy, tin, the like, etc., or a combination of at least any two above. The unique system can have at least one lace-section fastener. Each lace-section fastener can be separate from, attached to, or integrated to a footwear at any portion(s) thereof and can fasten at least one lace section thereon. For example, FIG. 4 shows the unique system having a lace-section fastener 58, which is equivalent to lace-section fastener 44. Lace-section fastener 58 comprises two opposite hooks, each attached to or integrated to one of opposite sides 50 and 51 of the footwear. Each of the opposite hooks is equivalent to hook 56 of lace-section fastener 44, and is for one of opposite lace sections 48 and 49 to be fastened thereon and to be unfastened therefrom to fasten the footwear onto and to unfasten the footwear from the foot, respectively. These fastening and unfastening methods are equivalent to the fastening and unfastening methods described in the first example above. For example, FIG. 4 shows lace 41, which can be made of elastic material and assembled as shown so that to fasten the footwear onto a foot or to unfasten the footwear from a foot, without the needs for tying lace 41 nor the needs for untying lace 41, respectively, the foot is inserted into the footwear or the foot is pulled out of the footwear, respectively. These fastening and unfastening methods are equivalent to the fastening and unfastening methods described in the first example. For example, the unique system can have two lace-section fasteners 58, each attached to or integrated to the footwear and functioning as described above, or can have lace-section fasteners 58 attached to or integrated to the footwear and functioning as described above and lace-section fasteners 44 separate from the footwear.

The unique system can be used with any type of footwear, for example, sneaker, tennis shoe, etc. Any element(s) of the unique system can be made separate from, attached to, or integrated to any other element(s) of the unique system and/or a footwear, which the unique system is used with.

The unique system can, further, comprise at least one relief, design, printing, painting, stamping, device, inscription, decal, engraving, embossing, decor, or a combination of at least any two above, which can be attached to or integrated to any element of the unique system. For example, a light-reflecting tape or a relief can be attached to or integrated to lace-section fastener 44.

Lace 41 can have at least one lace section. The lace-end fastener for fastening lace ends 46 and 47 can be a separate device from lace 41, e.g. a clamp. The foot can be inserted into the footwear before or after lace ends 46 and 47 are fastened to set predetermined lace tensions of lace 41. Lace ends 46 and 47 can be refastened any time to reset predetermined lace tensions of lace 41.

A lace-section fastener, equivalent to lace-section fastener 44, can comprise at least one hook, at least one ring, the like, the equivalent, or a combination thereof, which are made separately, attachedly, or integrally. Each hook is for at least one lace section of a lace to be hooked thereon. Each ring is for at least one lace section of a lace to be threaded therethrough. For example, a lace-section fastener, equivalent to lace-section fastener 44, can comprise a wire with its one half bent into a hook and its other half bent into a ring. The hook and ring function similarly as hook 56 and ring 57. For example, a lace-section fastener, equivalent to lace-section fastener 44, can comprise a wire spring, which is resilient. The wire spring has one of its two ends bent into a hook and the other one of its two ends bent into a ring. The hook and ring function similarly as hook 56 and ring 57. For example, a lace-section fastener, equivalent to lace-section fastener 44, can be made of the same material as the footwear and integrated to the footwear as part of the footwear.

Equivalent to the predeterminedly bent tip 59 of hook 56, which prevents hook 56 from snagging thing, poking thing, etc., a preventing device, for example, having the form of a hill, can be disposed adjacent to, attached to, or integrated to each hook of a lace-section fastener, which is equivalent to lace-section fastener 44, to prevent each hook from snagging thing, poking thing,etc.

Each lace receiver of a footwear with the unique system applied thereto can be disposed at any portion of the footwear, for example, the topside, the edge, or the underside of one of the opposite sides of the footwear. The footwear can be laced with a lace in any way to define any opposite lace sections of the lace and to form any lacing style, using some or all of its lace receivers.

Figure 5:
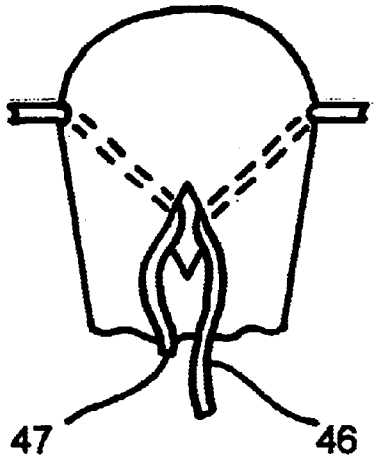
FIG. 5 shows another tongue.

The unique systems and methods are capable of various: variations, ramifications, equivalents, structures, materials, colors, forms, functions, dimensions, operations, permutations, styles, alternatives, extensions, arrangements, applications, configurations, simplifications, additions, adaptations, modifications, substitutions, combinations, associations, etc. without departing from the scope of the invention. For example, FIG. 5 shows a tongue, equivalent to tongue 40. Lace ends 46 and 47 are threaded through the tongue's openings. Similar to the examples in FIGS. 1–4, lace ends 46 and 47 are tied together and threaded back into the tongue to be hidden therein. The scope of the invention will be determined by the ensuing claims and their legal equivalents, rather than by the aforementioned exemplifications.

I claim:

1. A system comprising a tongue of a footwear, lacing means, lace-end-fastening means, and lace-section-fastening means, the footwear having two opposite sides and lace-receiving means disposed thereon, said lacing means having a plurality of lace sections and lace ends, the footwear laced with said lacing means so that each of said lace sections extending between two of said lace-receiving means on the same side, said tongue having at least one opening and outer and inner surfaces, each of said at least one opening extending from said outer surface to said inner surface, said lacing means threaded through said at least one opening, said lace ends fastened by said lace-end-fastening means and hidden inside said tongue, said lace-section-fastening means for at least one of said lace sections to be fastened thereon and to be unfastened therefrom to fasten the footwear onto and to unfasten the footwear from a foot, respectively.

2. The system of claim 1, wherein said lace-section-fastening means separate from the footwear.

3. The system of claim 1, wherein, said lace-section-fastening means attached to or integrated to the footwear.

4. The system of claim 1, wherein, said lace-section-fastening means selected from the group consisting of: at least one hook, at least one ring, and a combination thereof.

5. The system of claim 1, wherein, said lace-end-fastening means comprising said lace ends, said lace ends tied together so that said lace ends are fastened together.

6. The system of claim 1, further, comprising at least one element selected from the group consisting of: relief, design, printing, painting, stamping, device, inscription, decal, engraving, embossing, decor, and a combination of at least any two above.

7. A method for fastening footwear onto a foot, providing a footwear and a unique system, the unique system comprising a tongue of the footwear, a lace, and a hook and a ring integrated to each other, the footwear having two opposite sides and a plurality of lace-receivers disposed thereon, said lace having first and second lace sections and two lace ends, the footwear laced with said lace so that each of said first and second lace sections extending between two of said lace-receivers on the same side with said second lace section threaded through said ring, said tongue having at least one opening and outer and inner surfaces, each of said at least one opening extending from said outer surface to said inner surface, said lace threaded through said at least one opening, said lace ends tied together so that said lace ends fastened together and hidden inside said tongue, the method comprising the steps of:

pulling said first and second lace sections; and hooking said first lace section on said hook.

8. The method of claim 7, further, comprising the step of unhooking said first lace section from said hook.

* * * * *